United States Patent [19]

Cantwell et al.

[11] Patent Number: 4,827,958

[45] Date of Patent: May 9, 1989

[54] TENT

[75] Inventors: Robert R. Cantwell, Leslie, Mo.; Michael J. Scherer, Boulder, Colo.

[73] Assignee: American Recreation Products, Inc., New Haven, Mo.

[21] Appl. No.: 143,809

[22] Filed: Jan. 14, 1988

[51] Int. Cl.[4] ..... A45F 1/16

[52] U.S. Cl. ..... 135/104; 135/105; 135/119

[58] Field of Search ..... 135/102, 104, 105, 119, 135/101

[56] References Cited

U.S. PATENT DOCUMENTS

| | | | |
|---|---|---|---|
| 3,223,098 | 12/1968 | Dole, Jr. | 135/105 |
| 3,327,723 | 6/1967 | Burgin | 135/105 |
| 3,693,641 | 9/1972 | Moss | 135/104 |
| 3,834,410 | 9/1974 | Leibel | 135/3 |
| 3,943,953 | 3/1976 | Cantwell | 135/3 |
| 3,951,159 | 4/1976 | Robinson | 135/3 |
| 3,990,463 | 11/1976 | Norman | 135/104 |
| 4,078,572 | 3/1978 | Moss | 135/105 |
| 4,195,681 | 4/1980 | Watts et al. | 135/102 |
| 4,236,543 | 12/1980 | Moss | 135/105 |
| 4,251,015 | 2/1981 | Gale, Jr. | 135/102 |
| 4,541,445 | 9/1985 | Ferguson | 135/106 |
| 4,665,935 | 5/1987 | Nichols | 135/104 |

FOREIGN PATENT DOCUMENTS

| | | | |
|---|---|---|---|
| 1557406 | 3/1970 | Fed. Rep. of Germany | 135/105 |
| 3213781 | 2/1983 | Fed. Rep. of Germany | 135/104 |

*Primary Examiner*—David A. Scherbel
*Assistant Examiner*—Caroline D. Dennison
*Attorney, Agent, or Firm*—Senniger, Powers, Leavitt and Roedel

[57] ABSTRACT

A tent comprising a plurality of walls, a roof and a frame system for holding the tent erect. The frame system comprises at least two frame structures, each being of generally inverted U-shape when erect and comprising a pair of substantially rigid poles extending up from the ground adjacent respective walls of the tent and a flexible resilient ridge frame member bent into an arched configuration and having ends telescopically interfitted with the upper ends of the poles. The resilient ridge frame members support the roof of the tent in an arched configuration generally corresponding to the arched configuration of the ridge frame members.

16 Claims, 4 Drawing Sheets

TENT

BACKGROUND OF THE INVENTION

This invention relates generally to tents, and more particularly to tents sometimes referred to as umbrella tents.

Umbrella tents conventionally have an external frame from which the tent side and top panels are supported. In prior umbrella tents, the frame typically includes straight upright support poles on each side or at the corners of the tent to which the eaves of the tent are secured and a ridge frame extending across the roof of the tent from the upper ends of the support poles to support the roof of the tent in a peaked configuration. However, this roof configuration usually provides insufficient headroom to walk comfortably around the inside of the tent. Moreover, while umbrella tents are relatively simple to erect as compared to other types of tents, the number of support poles and ridge members heretofore required to make the tent stable have made the tent difficult and often confusing to erect. Also, the fact that staking the tent to the ground has usually been required makes it difficult to move the tent after it has been erected.

SUMMARY OF THE INVENTION

Among the several objects of this invention may be noted the provision of an umbrella tent having a roof supported in arched or domed configuration for greater standup or head room; the provision of such a tent having fewer support frame members to enable easy and quick erection of the tent; the provision of such a tent which is self-supporting, i.e., the tent may readily be picked up in an erected state and moved to a desired location; and the provision of such a tent which is attractive in appearance. Other objects and features of the invention will be in part apparent and in part pointed out hereinafter.

Briefly, a tent of the present invention comprises a plurality of walls, a roof and a frame system for holding the tent erect. The frame system comprises at least two frame structures, each being of generally inverted U-shape when erect and comprising a pair of substantially rigid poles extending up from the ground adjacent respective walls of the tent and a flexible resilient ridge frame member bent into an arched configuration and having ends telescopically interfitted with the upper ends of said poles. The resilient ridge frame members are adapted to support the roof of the tent in an arched configuration generally corresponding to the arched configuration of the ridge frame members.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
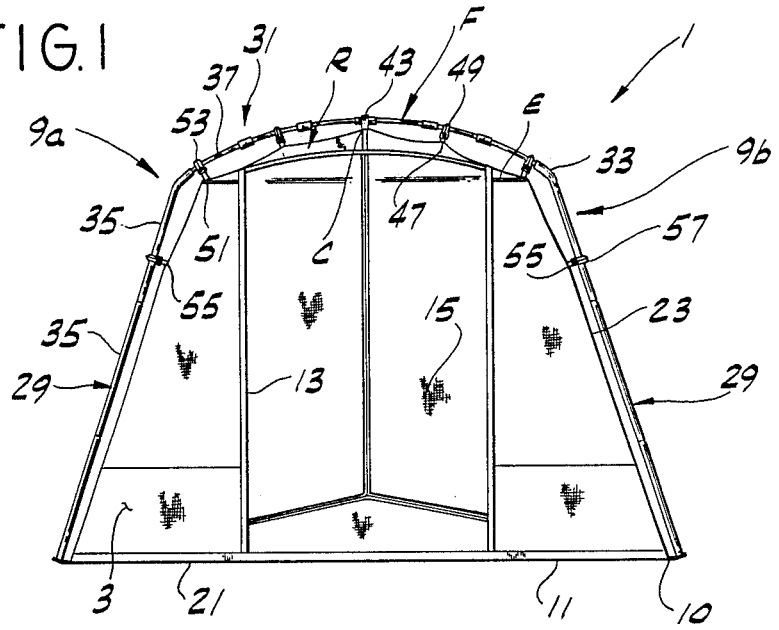
FIG. 1 is a front elevational view of a tent of this invention.
Figure 2:
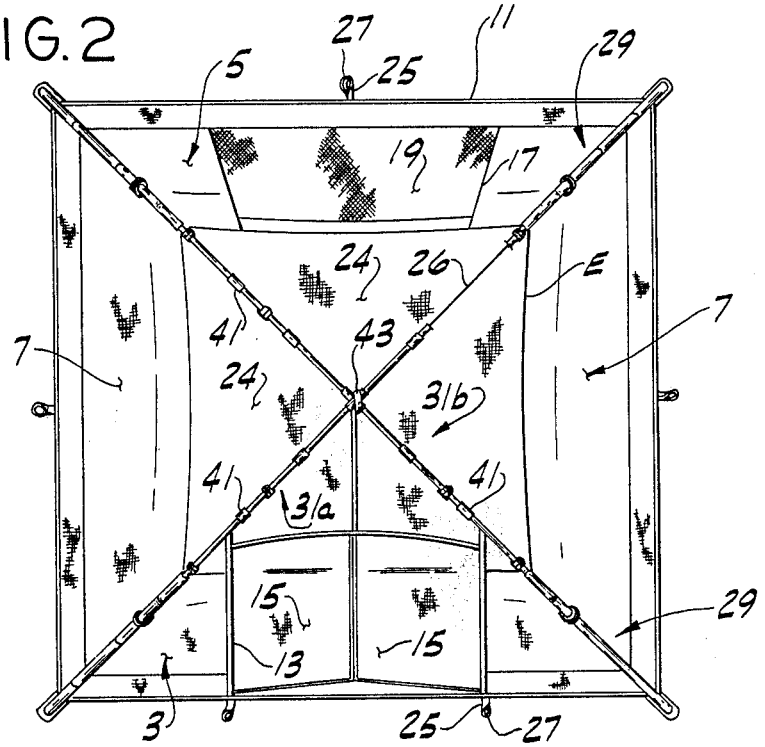
FIG. 2 is a top plan of FIG. 1.
Figure 3:
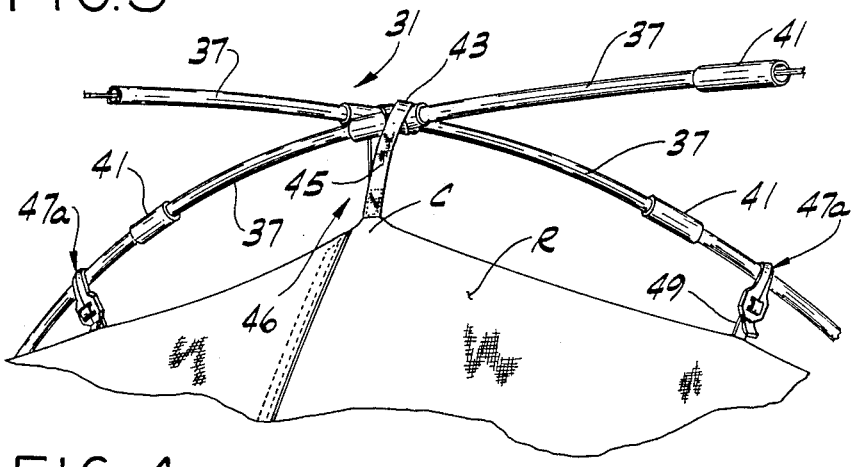
FIG. 3 is an enlarged portion of FIG. 1 showing two arched ridge frame members crossing above the roof of the tent and connection between the roof and the ridge frame members.

Referring now to FIGS. 1 and 2, a tent of the present invention is generally designated in its entirety by the reference numeral 1. In the particular embodiment illustrated, the tent has four walls (a front wall 3, rear wall 5 and opposite side walls 7) and a vaulted roof generally designated R, the upper edges of the walls constituting eaves E which generally form a rectangle (as viewed from above) when the tent is erect. An external frame system generally designated F holds the tent erect. The frame system comprises two frame structures generally designated *9a*, *9b*, each being of generally inverted U-shape when erect and extending over the roof in an arched configuration. In the embodiment shown, these two frame structures *9a*, *9b* are adapted to be installed in generally vertical intersecting planes with the frame structures crossing one another above the roof R of the tent generally centrally of the roof. The roof R of the tent is releasably connected to the frame structures *9a*, *9b* to hold the roof erect and in a configuration wherein thereof slopes generally upwardly from the eaves E to the center C of the roof, the eaves E being similarly connected to the frame structures to hold the walls 3, 5 and 7 of the tent erect. The lower corners 10 of the tent are releasably connected to the lower ends of the frame structures *9a*, *9b* rather than being staked to the ground.

More specifically, the tent 1 has a generally square floor panel 11 substantially larger in dimension than the roof R, the result being that the walls of the tent slope upwardly and inwardly from the floor of the tent to the eaves of the tent. Walls 3, 5 and 7 are substantially identical except that the front wall 3 has a door 13 formed by separable screens 15 and the rear wall 5 has a screen window 17. While not shown, the side walls 7 may also be provided with screens. The walls are generally in the shape of an isosceles trapezoid having their bases sewn to the outer edges of floor panel 11 along seams 21 and adjacent upright sides of walls 3, 5 and 7 sewn together along seams 23. Thus the floor panel 11 and walls 3, 5 and 7 form a truncated tetrahedron. Roof R is formed by four triangular roof panels 24. The base of each roof panel is sewn to the upper edge of a respective wall 3, 5 or 7 and thus constitutes an eave E. Adjacent sides of the roof panels are sewn together along seams 26 and the points of the roof panels are joined at the center C of the roof. The door 13 may extend above the eaves with a corresponding section removed from the roof to accommodate the door. A 10 plurality of loops 25 are stitched to the periphery of the floor panel 11 to receive stakes 27 for securing the tent to the ground.

Figure 4:
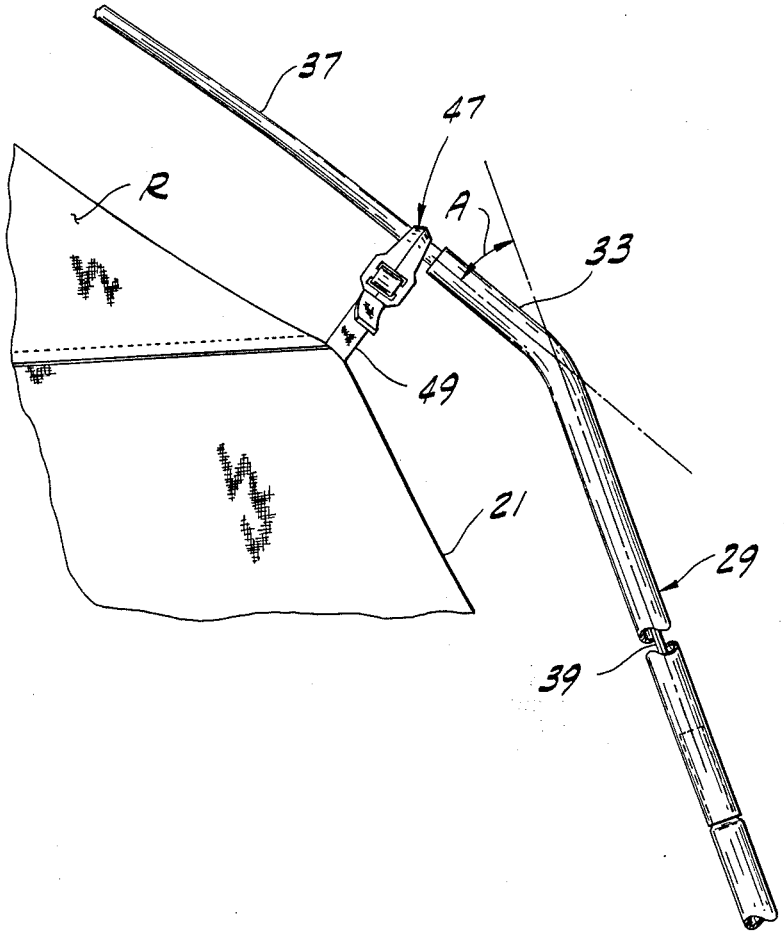
FIG. 4 is an enlarged portion of FIG. 1 showing a typical hook and loop connection between the eaves of the tent and the frame structure.
Figure 5:
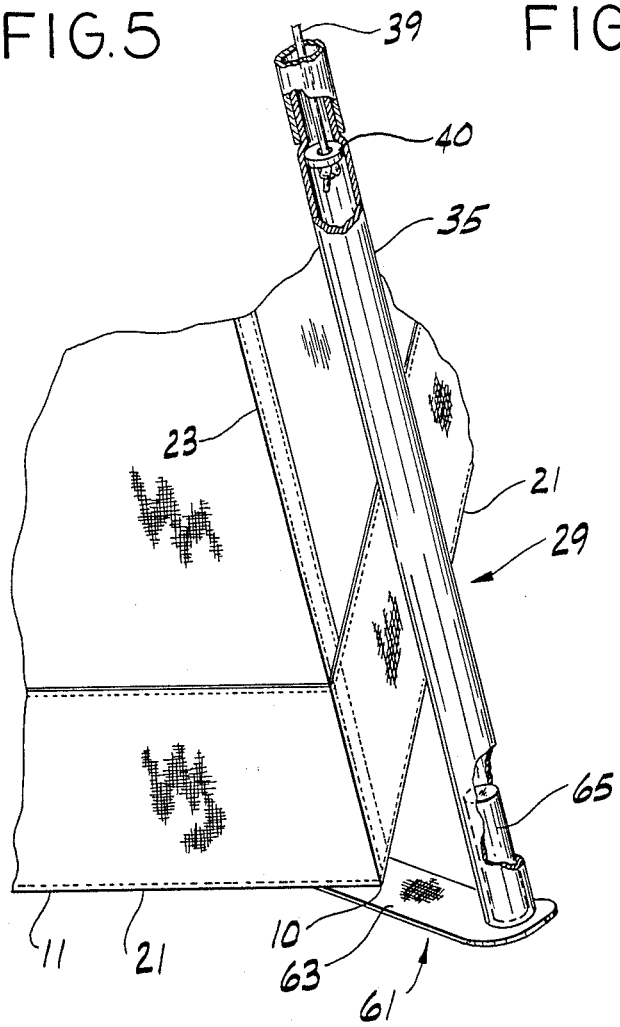
FIG. 5 is an enlarged portion of FIG. 1 showing a connection between a corner of the tent and a lower end of the frame structure, portions of the frame structure being broken away to show details.
Figure 6:
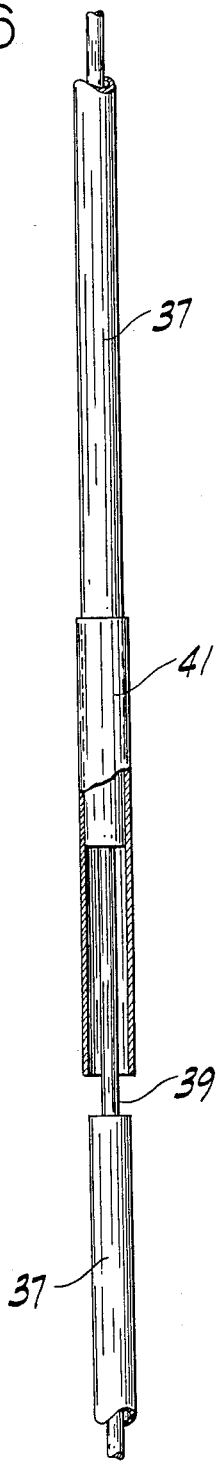
FIG. 6 is an enlarged portion of FIG. 1 showing details regarding the construction of a ridge frame member.

In accordance with the present invention, and as illustrated in FIG. 1, each frame structure 9a, 9b is of generally inverted U-shape and comprises a pair of rigid tubular poles generally designated 29 adapted to be installed to extend up from the ground on the outside of the tent generally parallel to the inclined walls of the tent, and a flexible resilient ridge frame member generally designated 31 adapted to be resiliently bent to extend over the roof of the tent in an arched configuration with its ends telescopically interfitted with the upper ends 33 of respective poles 29, as shown in FIG. 4. It is significant to note in this regard that each metal pole 29 is substantially straight along a major portion of its length and that it has an upper end portion 33 bent inwardly toward the center of the tent at an acute angle A in the range of 25°–40°, and preferably about 30°, relative to the longitudinal axis of the pole. The design is such that, with the ends of the ridge frame members 31 inserted into the bent upper end portions 33 of respective poles 29, the ridge frame members are held in a configuration wherein they arch over the roof.

Poles 29 are preferably made in tubular metal (e.g., aluminum) sections 35 formed to telescopically interfit with one another, the upper end of each section being swaged to fit in the lower end of the section above it. Each ridge frame member is also preferably made in tubular sections 37 of fiberglass, for example, with each section having a sleeve or ferrule 41 affixed to one end for telescopically receiving an end of an adjacent section. The poles 29 and ridge frame member 31 of each frame structure 9a, 9b are preferably "shock-corded", meaning that the tubular sections 35, 37 are connected by a tensioned elastic cord 39 extending axially through the sections substantially the entire length of the structure. The ends of the cord pass through retainers (e.g., washers) 40 located immediately below the swaged upper ends of the lowermost sections 35 of the poles 29 and are knotted to maintain the cord stretched in place. The cord serves to connect the sections and to releasably hold them in end-to-end relation. At the same time the cord also permits limited endwise separation of the sections 35, 37 so that they may be compactly arranged for convenient transport and storage. The fact that the sections 35, 37 of each frame structure are connected by the cord 39 also prevents the sections from becoming separated from one another and lost.

As illustrated in FIGS. 1 and 2, the two frame structures 9a, 9b are adapted to be installed in generally vertical intersecting planes extending generally diagonally with respect to the walls of the tent, the poles 29 thus being generally adjacent the seams 23 of the tent walls. The arched ridge frame members 31 cross one another above the roof R of the tent generally at the center C of the roof where they are releasably secured together by a strap 43 made of nylon or other suitable material having one end sewn to the outside of the roof and its other free end 45 wrapped around the ridge frame members and fastened by a suitable quick release fastener 46 (e.g., a "Velcro" fastener, S-hook or clip to the end of the strap sewn to the roof. It will be understood, of course, that this strap 43 also serves to hold the center C of the roof R erect.

Figure 7:
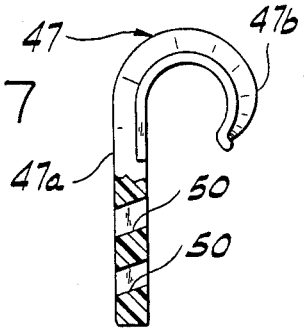
FIG. 7 is a view of hook used in the frame system, portions being, broken away to illustrate details.

To provide maximum headroom inside the tent, the roof of the tent is also releasably attached to the ridge frame members 31 at points intermediate the center C of the roof and the eaves E of the tent by a plurality of releasable fasteners such as hooks 47 connected to straps 49 made of nylon or other suitable material stitched to the roof of the tent. As shown in FIGS. 4 and 7, each hook 47 comprises an integral J-shaped plastic member having a relatively wide shank portion 47a and a hook end portion 47b sized to clip on a respective frame section 37. The shank portion 47a of the hook has a pair of parallel slots 50 therein for receiving strap 49 therethrough. The length of the strap 49 may be adjusted by pulling the free end of the strap the desired amount through slots 50, the strap being self-locking in fixed position when released As shown in FIG. 7, the slots 50 are angled (preferably about 25° off horizontal) to ensure that the strap remains locked in position when released The roof is thereby held erect in an arched configuration generally corresponding to the arched configuration of the ridge frame members 31. The eaves E of the tent are releasably attached to the ridge frame members 31 by additional hooks 47 connected to straps 51 sewn to the eaves adjacent the upper end portions 33 of the poles 29. These latter connections serve to hold the walls 3, 5 and 7 of the tent erect. Additional support to the walls of the tent is provided by hook-and-strap connections 55, 57 spaced below the eaves of the tent. It is contemplated that additional connections may also be provided without departing from the scope of this invention.

Each corner 10 of the tent adjacent the floor of the tent is releasably connected to the lower end of an adjacent pole 29 of a respective frame structure 9a, 9b by means comprising a flexible tab 63 secured to the corner of the tent on the outside, as by sewing or other suitable means of attachment, and a solid cylindrical plug 65 on the tab having a diameter slightly less than the inner diameter of the pole 29. The plug is adapted to be inserted in the lower end of the pole thereby to stretch the floor panel 11 into its intended shape and secure the bottom of the tent to the frame system. This arrangement, in concert with the resilience of the flexible arches or ridge frame members 31, renders the tent self-supporting, thereby enabling it to be picked up in an erected state and moved to a desired location. Unlike conventional tents, staking the tent to the ground is not necessary to maintain the tent erect.

While not illustrated in the drawings, a water-proof fly may be installed above the tent of the present invention to shield the tent from the elements if the tent is constructed using fabrics which require shielding. The fly may be generally square and is preferably releasably attached at its corners to the upper ends of the pole 29 by conventional hook-and-loop connections.

To erect a tent 1 of this invention, the shock-corded sections 35, 37 of the poles 29 and ridge frame members 31 are interfitted (with the aid of the shock-cord 39) in end-to-end telescoping relation to form the two frame structures 9a, 9b of inverted-U shape, erecting the frame structures so that they are positioned in vertical intersecting planes as shown in FIGS. 1 and 2, and then inserting the plugs 65 at the corners of the unfolded floor panel 11 into the lower ends of the poles 29. The roof R and walls of the tent are then raised, the free end 45 of roof strap 43 wrapped around the ridge frame members 31 at the point where they cross, and the free end of the strap secured by the quick release fastener 46. With this accomplished the other loops 47 sewn to the roof and the loops 51 sewn to the eaves E are connected by hooks 49 and 53, respectively, to respective ridge frame members 31. The loops 55 on the walls 3, 5 and 7 are then connected by hooks 57 to adjacent poles 29. Finally, if warranted by the circumstances (such as high winds), stakes 27 may be driven into the ground through loops 25 to secure the tent in fixed position to the ground.

It will be apparent from the foregoing that the umbrella tent 1 of the present invention has a roof R supported in arched or domed configuration for greater head room, has fewer support frame members to enable easy and quick erection, and is attractive in appearance. Moreover, the tent is self-supporting and may therefore be conveniently picked up in an erected state and shifted or moved to a desired position.

Figure 8:
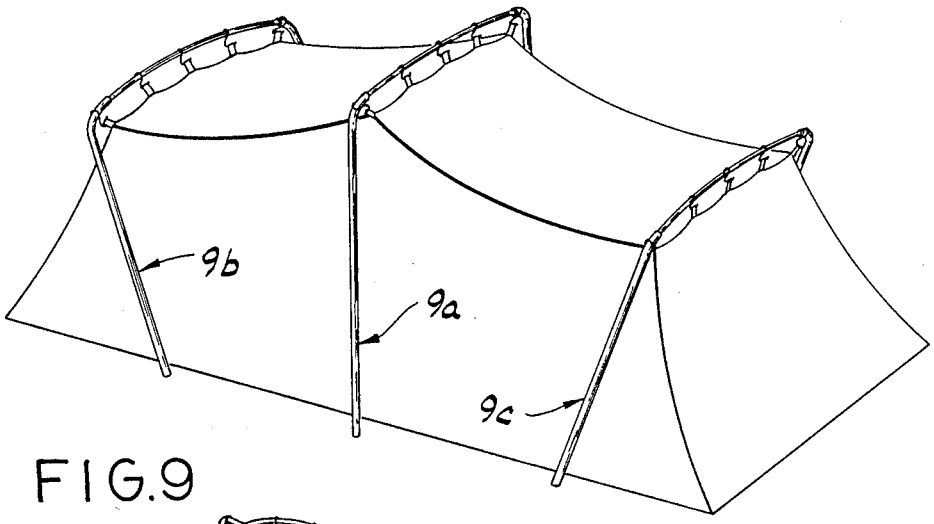
FIG. 8 is a first alternative tent design using the unique frame structures of the present invention.
Figure 9:
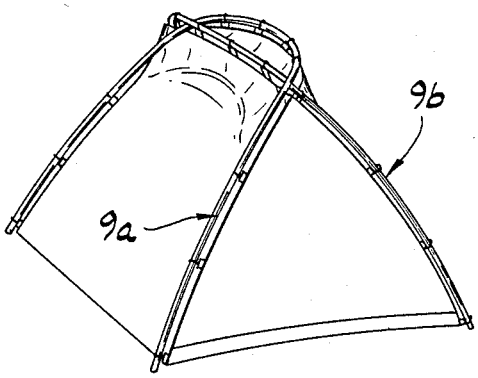
FIG. 9 is a second alternative tent design using the unique frame structures of the present invention.

FIGS. 8 and 9 illustrate other tent configurations incorporating the unique frame system of the present invention. The tent of FIG. 8 is a relatively long tent having quadrilateral front, rear and side walls and a generally rectangular roof, all of which are held erect by an external frame system comprising three frame structures 9*a*, 9*b* and 9*c* of inverted U-shape extending in side-to-side direction with respect to the tent, one (9*a*) at the center of the tent and two (9*b* and 9*c*) adjacent opposite ends of the tent. As shown, the center frame structure 9*b* lies in a generally vertical plane and the end frame structures 9*b*, 9*c* lie in planes angling up from the ground away from the center of the tent. Suitable releasable fasteners connect the tent to the frame structures to hold the tent erect. The frame structures are of the same dual composite construction as the frame structures 9*a* and 9*b* of the embodiment of FIGS. 1–6.

The tent of FIG. 9 is a smaller tent having triangular front and rear walls, quadrilateral side walls and a generally oval roof. The walls and roof are held erect by two frame structures 9*a* and 9*b* of the same dual composite construction as the frame structures 9*a* and 9*b* of FIGS. 1–6. These frame structures extend in planes angling upwardly from the ground at the sides of the tent and intersect at points adjacent the upper edges of the front and rear walls of the tent.

Figure 10:
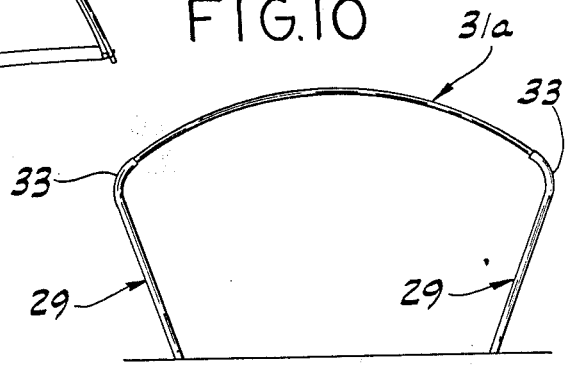
FIG. 10 is an illustration showing a frame structure of the present invention arched to a greater degree.

Other tent configurations using the unique dual composite frame structures of the present invention are also contemplated. It will be understood in this regard that the frame structures used in a particular tent may vary in number and orientation relative to one another, and that they may be positioned inside rather than outside the tent. Moreover, the frame structures may vary in size and shape with respect to one another; and the flexible resilient ridge frame members of different frame structures may be flexed into arched configurations of varying degree, depending on the desired shape and construction of the tent. For example, as illustrated in FIG. 10, it will be understood that the ridge frame member 31*a* will assume a greater degree of arch if the lower ends of the two poles 29 of the frame structure are moved closer together, and that the ridge frame member will assume a lesser degree of arch if the lower ends of the two poles are moved farther apart. Of course, the degree of arch of the ridge frame member may also be varied by varying the angle at which the upper end portions of the poles are bent.

In view of the above, it will be seen that the several objects of the invention ar achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A tent comprising a plurality of walls, a roof and a frame system for holding the tent erect, said frame system comprising at least two frame structures, each being of generally inverted U-shape when erect and comprising a pair of substantially rigid metal poles extending up from the ground adjacent respective walls of the tent and a flexible resilient ridge frame member bent into an arched configuration and having ends telescopically interfitted with the upper ends of said poles, said resilient ridge frame members being adapted to support the roof of the tent in an arched configuration generally corresponding to the arched configuration of said ridge frame members.

2. A tent as set forth in claim 1 wherein each pole is substantially straight along a major portion of its length and has an upper end portion bent inwardly toward the tent at an angle relative to the longitudinal axis of said major portion of the pole.

3. A tent as set forth in claim 2 wherein said upper end portion of each pole is bent at an angle in the range of 25°–40° relative to the longitudinal axis of said major portion of the pole.

4. A tent as set forth in claim 1 wherein said poles are of aluminum and said ridge frame members are of fiberglass.

5. A tent as set forth in claim 4 wherein each frame structure comprises a plurality of tubular sections, and tensioned elastic cord means extending axially through the sections for connecting the sections and releasably holding them in end-to-end relation, said elastic cord means being adapted to be stretched to permit limited end-wise separation of the sections and placement of the sections in a compact arrangement.

6. A tent as set forth in claim 1 further comprising means for releasably connecting a respective wall of the tent adjacent its lower edge to the lower end of a respective pole of a respective frame structure whereby the tent is rendered self-supporting.

7. A tent as set forth in claim 6 wherein said means for connecting a wall of the tent to the lower end of a respective pole comprises a flexible tab adjacent the lower edge of the wall on the outside of the tent, and a plug on the tab receivable in the lower end of said pole.

8. A tent as set forth in claim 1 wherein said frame system is an external frame system with said poles being adapted to extend up from the ground on the outside of the tent and said ridge frame members are adapted to extend in arched configuration over the roof of the tent, said tent further comprising means for releasably connecting the roof to said ridge frame members to hold the roof in an arched configuration.

9. A tent as set forth in claim 8 wherein each pole is substantially straight along a major portion of its length and has an upper end portion bent inwardly toward the tent at an angle relative to the longitudinal axis of said major portion of the pole.

10. A tent as set forth in claim 9 wherein said upper end portion of each pole is bent at an angle in the range of 25°–40° relative to the longitudinal axis of said major portion of the pole.

11. A tent as set forth in claim 10 wherein said poles are of aluminum and said ridge frame members are of fiberglass.

12. A tent as set forth in claim 8 wherein said two frame structures are adapted to be installed in generally vertical intersecting planes with the arched ridge frame members crossing one another above the roof of the tent generally centrally of the roof.

13. A tent as set forth in claim 12 wherein said roof is adapted to be connected to said ridge frame members generally at the point where the ridge frame members cross generally at the center of the roof and at points intermediate the center of the roof and the upper edges of the walls of the tent.

14. A tent as set forth in claim 13 wherein said means for releasably connecting the roof of the tent to said ridge frame members comprises a tie attached to the roof on the outside of the roof generally at the center of the tent and a plurality of ties attached to the roof on the outside of the roof at points intermediate the center of the roof and the upper edges of the walls of the tent.

15. A tent as set forth in claim 14 wherein said tent comprises front, rear and opposite side walls, said frame structures being adapted to be positioned in generally vertical intersecting planes extending generally diagonally with respect to the walls of the tent.

16. A tent as set forth in claim 1 further comprising means for releasably connecting the walls of the tent to said frame structures thereby to hold the walls of the tent erect.

* * * * *